US005766304A

United States Patent [19]

Uenosono et al.

[11] Patent Number: 5,766,304

[45] Date of Patent: Jun. 16, 1998

[54] IRON-BASE POWDER MIXTURE FOR POWDER METALLURGY AND MANUFACTURING METHOD THEREFOR

[75] Inventors: Satoshi Uenosono; Kuniaki Ogura, both of Chiba, Japan

[73] Assignee: Kawasaki Steel Corporation, Japan

[21] Appl. No.: 637,228

[22] Filed: Apr. 24, 1996

[30] Foreign Application Priority Data

Apr. 25, 1995 [JP] Japan ..... 7-124468

[51] Int. Cl.[6] ..... B22F 1/00

[52] U.S. Cl. ..... 75/252; 75/255

[58] Field of Search ..... 75/252, 255

[56] References Cited

U.S. PATENT DOCUMENTS 5,256,185 10/1993 Semel et al. ..... 75/255
5,279,640 1/1994 Ogura et al. ..... 75/343
5,401,292 3/1995 Japka ..... 75/233

FOREIGN PATENT DOCUMENTS 0 310 115 A1 4/1989 European Pat. Off. .
2 157 711 10/1985 United Kingdom .
92-18275 10/1992 WIPO ..... 75/252

*Primary Examiner*—George Wyszomierski
*Attorney, Agent, or Firm*—Austin R. Miller

[57] ABSTRACT

An iron-base mixture and method for powder metallurgy containing iron-base powder, an alloy powder including at least copper, copper oxide or both, and an organic substance for bonding the alloy powder to the iron-base powder, wherein said copper powder or copper oxide powder has a particle size of agglomeration, when evaluated by the micro-track method, of about 5 μm to 28 μm, and wherein the particles of copper or copper oxide have a primary particle size which, when evaluated by the BET method, is about 0.2 μm to 1.5 μm.

9 Claims, 1 Drawing Sheet

IRON-BASE POWDER MIXTURE FOR POWDER METALLURGY AND MANUFACTURING METHOD THEREFOR

BACKGROUND OF THE INVENTION

1. Field of the Invention

The present invention relates to a method of manufacturing an iron-base powder mixture containing added alloy powder such as copper, copper oxide, graphite or iron phosphide. The powder mixture of this invention is useful for powder metallurgy and has a structure and arrangement that is capable of satisfactorily preventing segregation of, or dust generation by, the added copper or copper oxide powder. The resulting powder mixture exhibits excellent fluidity without significant variation of its beneficial advantages even with extended passage of time.

2. Related Background Art

Iron-base powder mixtures for powder metallurgy have generally been manufactured by adding, to iron powder, an alloy powder such as copper powder, graphite powder or iron phosphide, followed by adding a further powder having properties for improving machinability if necessary, and followed by mixing a lubricant such as zinc stearate, aluminum stearate or lead stearate into the powder. The lubricant is selected to achieve satisfactory mixing properties with respect to the metal powder and its thermal decomposition during subsequent sintering.

However, mixing methods of the foregoing type have encountered problems. One critical problem is that the mixed raw material tends to segregate. Since the powder mixture normally includes various powders having different shapes and densities, the powder mixture tends to segregate after mixing. This occurs notably when the powder mixture is introduced into a hopper or discharged from a hopper, or when a molding process is performed. For example, it has been known that a mixture of iron-base powder and graphite powder segregates in a transport container during shipment and the graphite powder "floats" due to vibrations during trucking. Graphite content in mixture of iron powder and graphite powder fluctuates in an initial stage, in an intermediate stage and in a final stage of the process for discharging the product from the hopper. This is largely due to segregation in the hopper.

Because of segregation the product composition varies significantly, producing scattered sizes and strengths. Thus, defective products tend to result.

Since graphite powder and the like are in the form of a fine powder, the specific surface area of the mixture is enlarged, thus resulting in deterioration of fluidity which in turn reduces the available injection speed into the mold. This reduces the speed at which green compacts can be manufactured.

Techniques have been described for preventing segregation of powder mixtures. Methods have been disclosed in Japanese Patent Laid-Open No. 56-136901 and Japanese Patent Publication No. 58-28321 in which a binding material is used. However, when the quantity of the binding material is increased enough to prevent segregation of the powder mixture, the fluidity of the powder mixture deteriorates.

We have suggested methods in Japanese Patent Laid-Open No. 1-165701 and Japanese Patent Laid-Open No. 2-47201 in which a eutectic of metallic soap or wax and oil is used as a bonding material. Such methods are capable of considerably reducing segregation of the powder mixture, and reducing dust generation from the same, and of improving fluidity. However, they have experienced a further problem in that the fluidity of the powder mixture varies from time to time due to the presence of the bonding material.

Accordingly, we have disclosed a method in Japanese Patent Laid-Open No. 2-57602 in which a eutectic of oil having a high melting point and metallic soap serves as a bonding material. Such a technique essentially prevents variation of the eutectic with passage of time, thus limiting variation of fluidity of the powder mixture with time. However, this method encounters another problem in that the apparent density of the powder mixture is undesirably changed.

To overcome the apparent density problem, we have disclosed a method in Japanese Patent Laid-Open No. 3-162502 in which the surface of the iron-base powder is coated with fatty acid, and then additives are adhered to the surface of the iron-base powder by using a eutectic of fatty acid and metallic soap, and then the metallic soap is added to the surface of the powder.

Copper powder, which is often the most important component to be added to the alloy, cannot satisfactorily be adhered to the iron-base powder even if any of the foregoing methods is employed. Thus, excessive segregation of copper powder takes place, and presents a serious problem.

SUMMARY OF THE INVENTION

An object of the present invention is to overcome the foregoing problems.

We have now discovered that copper powder or copper oxide powder shape or configuration defined by the primary particle size and the agglomerate particle size have a strong effect on the segregation of copper powder or copper oxide powder. Moreover, the present invention utilizes discovered knowledge that special processing of the surface of the alloy powder, especially copper or copper oxide, further increases the degree of its adhesion to the iron powder.

DETAILED DESCRIPTION OF THE INVENTION

Figure 1:
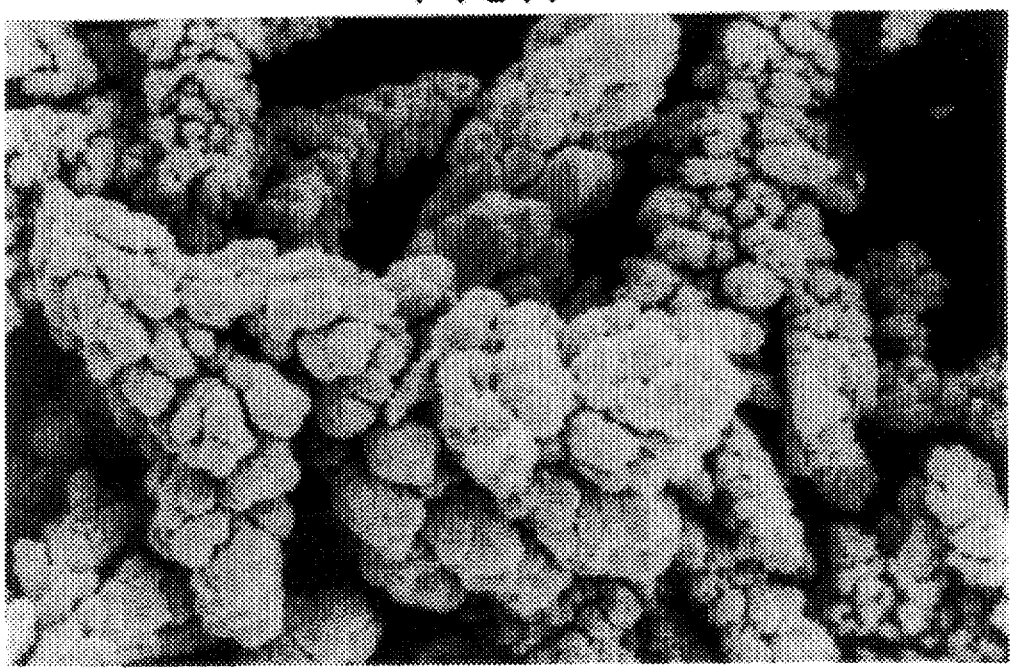
FIG. 1 is an electron microscopic photograph showing the shape of electrolytic copper powder with a magnification of 100 times.

According to the present invention there is provided an iron-based mixture for powder metallurgy comprising at least one or more types of added powder containing an alloy powder including at least copper powder or copper oxide powder; and containing an organic substance for bonding the alloy powder containing at least copper powder or copper oxide powder to the iron-base powder, wherein said copper powder or copper oxide powder agglomerates have a particle size of agglomeration, when evaluated by the so-called micro-track method, of about 5 μm to 28 μm, and wherein said copper powder or copper oxide powder particles have a primary particle size, when evaluated by the so-called BET method, of about 0.2 μm to 1.5 μm.

In the so-called micro-track method the particle size of agglomeration when evaluated by the micro-track method is the mean particle size measured by using the known laser diffraction type micro-track particle size analyzer.

The primary particle size evaluated by the BET method is the particle size determined from the specific surface area measured by the BET method, on the assumption that all particles have spherical shapes and the same particle size, the primary particle size evaluated by the BET method being obtained from the following equation:

$$\text{Primary Particle Size} = \frac{3}{(\text{Density of Alloy Powder}) \times (\text{Specific Surface Area})}$$

In the case of copper or copper oxide powder, it is preferable that the adhesion degree of Cu powder to iron powder, which is defined by the following equation:

$$\frac{\text{Cu content of mixed powder passed through a-325\# screen}}{\text{Cu content of over all mixed powder}}$$

is about 2 or less.

It is preferable that the organic substance is a eutectic of a fatty acid and a metallic soap, or a combination of two or more waxes having different melting points.

It is preferable that about 0.1 wt % to 2 wt % polyvinylalcohol (hereinafter called "PVB") be allowed to adhere to the surface of the copper powder or the copper oxide powder. It is also preferable that the surface of the copper powder or copper oxide powder be subjected to surface treatment with about 0.1 wt % to 2 wt % of a Si coupling agent or an Al coupling agent. It is further preferable that about 0.1 wt % to 2 wt % graphite also be adhered to the surface of the copper powder or the copper oxide powder.

It is preferable that the copper powder be oxidation-reduction copper powder.

A preferred method according to this invention for manufacturing an iron-base mixture for powder metallurgy comprises the steps of: adding a fatty acid which is liquid at room temperature to an iron-base powder, as a primary mixing operation; adding a metallic soap and one or more types of alloy powder comprising at least copper powder or copper oxide powder to perform a secondary mixing operation; and raising the temperature during the mixing process for performing the secondary mixing operation, or after the process for performing the secondary mixing operation has been performed, so as to contact the fatty acid and the metallic soap and generate a eutectic of the fatty acid and the metallic soap; cooling the fatty-acid-soap eutectic while cooling and anchoring the eutectic so that the added powder containing at least copper powder or copper oxide powder is firmly anchored to the surfaces of the iron-base powder particles due to the bonding force of the eutectic; and cooling while adding metallic soap or wax while still further mixing. It is important that the copper powder, or the copper oxide powder, has a particle size of agglomeration, when evaluated by the micro-track method, of about 5 μm to 28 μm and that its individual particles have a primary particle size, when evaluated by the BET method, of about 0.2 μm to 1.5 μm.

According to another aspect of the present invention, there is provided a method of manufacturing an iron-base mixture for powder metallurgy comprising the steps of: adding one or more types of powder of an alloy containing at least copper powder or copper oxide powder and two or more types of waxes having different melting points to the iron-base powder to perform a primary mixing operation; raising the powder temperature while performing the primary mixing operation or after primary mixing has been performed, wherein waxes with lower melting point melt and waxes with higher melting point do not melt; cooling the partial melt of the wax while further mixing the same to cool and anchor the partial melt so as to anchor the powder of the alloy to the surface of the iron-base powder particles due to the bonding force of the partial melt; and adding metallic soap or wax with cooling so as to perform a third mixing operation, wherein the copper powder or the copper oxide powder has a particle size of agglomeration, when evaluated by the micro-track method, of about 5 μm to 28 μm and its particles have a primary particle size, when evaluated by the BET method, of about 0.2 μm to 1.5 μm.

It is preferable that about 0.1 wt % to 2 wt % PVB be adhered to the surface of the copper powder or the copper oxide powder. It is preferable that the surface of the copper powder or the copper oxide powder be subjected to surface treatment with about 0.1 wt % to 2 wt % Si coupling agent or Al coupling agent. It is preferable that about 0.1 wt % to 2 wt % graphite be adhered to the surface of the copper powder or the copper oxide powder.

It is preferable that the copper powder be oxidation-reduction copper powder.

Important technical concepts of the present invention and reasons for the numerical limitations specified, will now be described.

Although copper is helpful to strengthen a sintered iron-base powder, separate forming of a mixture of the copper powder, the iron-base powder and the other ingredients often results in unsatisfactory adhesion to the iron-base powder. Thus, copper tends to become undesirably segregated or formed into dust as the mixture is handled. We have energetically researched the problem with particular attention to the shape of the iron-base powder. As a result, we have discovered that important and unexpected advantages are obtained if the copper or copper oxide powder is given unusual priority to adhere to concave portions of the iron-base powder. This is important.

The mean particle size of the iron-base powder usually employed in powder metallurgy has been found to be about 80 μm and the diameter of each concave portion of the particle has been found to be about 5 μm to 20 μm. To cause copper powder to be introduced into the concave portions of the iron particles, the particle size of agglomeration of the copper or copper oxide powder, which is the apparent particle size of the copper or copper oxide powder, must be about 5 μm to 28 μm. If the particle size of agglomeration is larger than about 28 μm, copper or copper oxide powder cannot be successfully introduced into the aforementioned concave portions of the iron powder. Copper or copper oxide particles having a particle size of agglomeration of less than about 5 μm are excessively costly and not practical to use.

In order to increase the adhesion strength between the alloy powder and the iron powder, the copper powder must be coated uniformly with organic substances which act as binders. By making the diameter of each of the primary particles in the agglomerated powder to about 0.2 μm to 1.5 μm, molten organic substances are able successfully to penetrate by capillarity into voids in agglomerated copper powders.

Low cost copper powder having a primary particle size of less than about 0.2 μm is not readily available. If its primary particle size is greater than about 1.5 μm, the resulting degree of adhesion is reduced. For the foregoing reasons, the optimum particle size of agglomeration, when evaluated by the micro-track method, is about 5 μm to 28 μm and the primary particle size of the same, evaluated by the BET method, is about 0.2 μm to 1.5 μm .

Whether or not copper powder has been adhered to the iron-base powder is important. Free copper or adhered copper is evaluated depending upon the foresaid adhesion degree of Cu powder to iron powder, which is defined by the following equation:

$$\frac{\text{Cu content of mixed powder passed through a -325\# screen}}{\text{Cu content of over all mixed powder}}$$

is about 2 or less.

That is, since the ratio of iron-base powder having a particle size of −325 mesh is low and the particle size of agglomeration of copper powder is less than 45 μm, the foregoing ratio would become 1 if all of copper particles were adhered uniformly and completely to the iron-base powder, regardless of the particle size of the iron-base powder. The more the free copper powder content increases, the higher becomes the foresaid adhesion degree of Cu powder to iron powder, which is defined by the following equation:

$$\frac{\text{Cu content of mixed powder passed through a-325\# screen}}{\text{Cu content of over all mixed powder}}$$

is about 2 or less, and easily becomes higher than 1. As a result of our investigations of segregation and dust generation, it has been discovered that no substantial practical problem of copper powder segregation or dust generation arises when the adhesion degree of Cu powder to iron powder, which is defined by the following equation:

$$\frac{\text{Cu content of mixed powder passed through a-325\# screen}}{\text{Cu content of over all mixed powder}}$$

is about 2 or lower

It is preferable that the organic substance for anchoring iron-base powder and copper powder be a eutectic of a fatty acid and a metallic soap or a combination of two or more waxes having different melting points. The method disclosed by us in Japanese Patent Laid-Open No. 3-162502 enables molten substances to penetrate into agglomerated copper powder particles in a eutectic state due to capillarity. Thus, the foregoing method is most suitable to coat the overall body of each particle. Also a combination of two or more waxes having different melting points is a preferred substance because the copper powder can be coated uniformly.

In the case where about 0.1 wt % to 2 wt % PVB is adhered to the surface of the copper powder, the organic substance contained in the powder mixture and the PVB form a eutectic compound so that the resulting anchoring property in the iron-base powder is further improved. If the content of PVB is lower than about 0.1 wt %, the degree of adhesion is unsatisfactorily low. It is difficult to cause the PVB to adhere if its content is higher than about 2 wt %.

When the surface of the copper powder is subjected to surface treatment with about 0.1 wt % to 2 wt % of an Si- or Al-type coupling agent, the organic substances contained in the powder mixture and the coupling agent are chemically bonded to each other so that the anchoring to the iron-base powder is further improved. If the coupling agent content is lower than about 0.1 wt %, the degree of adhesion of the copper powder is unsatisfactorily low. If the coupling agent is added in a content higher than about 2 wt %, cost of addition is excessively enlarged.

Since the adherability of the graphite powder to the iron-base powder is stronger than that of the copper powder, anchoring the graphite powder to the surface of the copper powder in an amount of about 0.1 wt % to 2 wt % enables the copper powder to be more fixedly anchored to the iron-base powder through the graphite powder. If the graphite powder content is lower than about 0.1 wt %, the degree of adhesion is unsatisfactorily low. The graphite powder cannot adhere to the copper powder in a quantity higher than about 2 wt %.

It is preferable that the foregoing method includes the addition of a fatty acid which is liquid at room temperature to the iron-base powder. After primary mixing a metallic soap and an alloy powder containing at least copper or copper oxide powder is added, having a particle size of agglomeration, when evaluated by the micro-track method, of about 5 μm to 28 μm, and the particles having a primary particle size, when evaluated by the BET method, of about 0.2 μm to 1.5 μm, mixing the coated iron-base powder with the coated alloy powder, heating the mix during or after the mixing operation so as to generate a eutectic of the fatty acid and the metallic soap; cooling and anchoring the eutectic so that said copper powder, copper oxide powder or graphite powder is anchored to the surface of the iron-base powder particles due to bonding force of the eutectic; and mixing added metallic soap or wax during the cooling operation.

In accordance with this invention we may perform the steps of adding (A) one or more types of powder of an alloy containing at least copper or copper oxide powder having an agglomeration particle size, when evaluated by the micro-track method, of about 5 μm to 28 μm and the particles having a primary particle size, when evaluated by the BET method, of about 0.2 μm to 1.5 μm, and (B) two or more waxes having different melting points, and adding (A) and (B) to an iron-base powder to perform a primary mixing operation; raising the powder temperature while or after performing the primary mixing operation so as to generate partial melting of the wax; cooling the partially melted wax while mixing the same to cool and anchor the partial melt so as to anchor the alloy powder to the surface of the iron-base powder particles due to the bonding force of the partial melt; and adding metallic soap or wax while mixing and cooling.

It is preferable that about 0.1 wt % to 2 wt % PVB be adhered to the surface of the copper or copper oxide powder. It is preferable that the surface of the copper or copper oxide powder be subjected to surface treatment with about 0.1 wt % to 2 wt % Si coupling agent or Al coupling agent. It is preferable to use copper powder to which about 0.1 wt % to 2 wt % graphite is adhered. This is a preferred embodiment.

The copper powder is exemplified by electrolytic copper powder, reduction powder of copper oxide, or the like. It is preferable to use a reduction powder of copper oxide because it has a shape that includes small voids that are observable when the inner portion of the agglomerated particles is observed microscopically.

Figure 2:
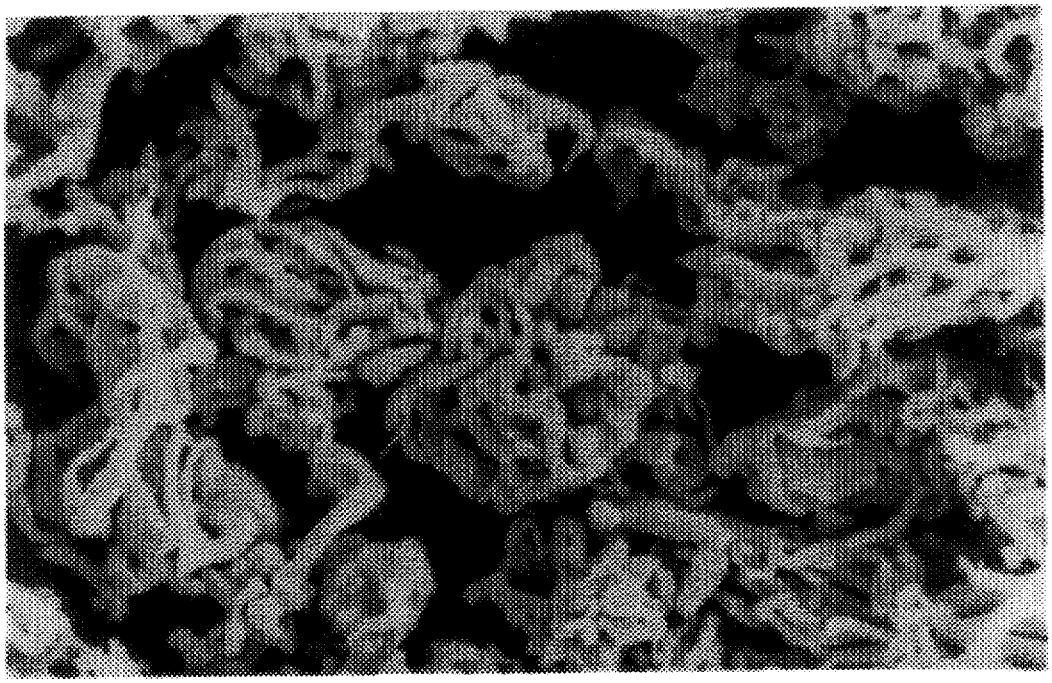
FIG. 2 is an electron microscopic photograph showing the shape of reduction powder of copper oxide with a magnification of 100 times.

FIGS. 1 and 2 of the drawings are electron microscope photographs of effective electrolytic copper powder. The powder of FIG. 1 has a shape formed by bonding primary particles in a branch-like configuration. Turning to FIG. 2, the reduction powder of copper oxide has whisker-like fiber shapes which are loosely bonded like eyebrows, as shown in FIG. 2. Thus, the primary particle size of the reduction powder of copper oxide is smaller than that of the electrolytic copper powder if the two types of powder have the same particle size of agglomeration. When mixing is performed, copper powder adheres while repeatedly colliding with particles of the iron powder. The reduction powder of copper oxide deforms and becomes adaptable to the concave portions of iron powder when caused to adhere to the iron powder. On the other hand, electrolytic copper powder does not deform when mixed. Therefore, reduction powder of copper oxide more strongly adheres, as compared with electrolytic copper powder.

Although particular emphasis has been applied herein to the use of copper powder, experiments have revealed that a similar effect is obtained when copper oxide powder ($Cu_2O$) is employed in place of copper powder. The surface of copper oxide powder has excellent adherability to organic substances as compared with metal powder. Therefore, the foregoing description fully applies to the use of copper oxide or copper oxide powder instead of, or in addition to, copper powder.

Other objects, features and advantages of the invention will be evident from the following detailed description of specific examples of the preferred embodiments as described in conjunction with the drawings heretofore mentioned.

EXAMPLES

Mixing Method 1

This invention will now be described with reference to a compilation of specific examples which were conducted by us or under our direction. The examples are intended to be illustrative and not to define or to limit the invention, which is defined in the appended claims.

0.3 wt % oleic acid was sprayed on powder metallurgy iron powder having a mean particle size of 78 μm and uniformly mixed for three minutes (primary mixing). Then, 1 wt % natural graphite powder having a mean particle size of 23 μm, 0.4 wt % zinc-stearate and 2 wt % copper powder, having a particle size of agglomeration and a primary particle size as shown in Table 1, were added and well mixed.

The mixture was then heated and further mixed at 110° C. (secondary mixing), followed by cooling to a level lower than 85° C. while being further mixed (third mixing). Thus, a powder mixture was manufactured in which graphite powder and copper powder were anchored to iron powder by a eutectic bonding material of oleic acid and zinc-stearate. Then, 0.3 wt % zinc-stearate was added and the product uniformly mixed (fourth mixing), followed by being discharged from the heat mixing unit.

Mixing Method 2

1 wt % natural graphite powder having a mean particle size of 23 μm, 0.4 wt % mixture of stearic amide and ethylene bisstearic amide and 2 wt % copper powder having a particle size of agglomeration and a primary particle size shown in Table 1 were added to powder metallurgy iron powder having a mean particle size of 78 μm and well mixed. The mixture was then heated and further mixed at 110° C. (primary mixing), followed by cooling to a level lower than 85° C. while further mixed. Thus, a powder mixture was manufactured in which graphite powder and copper powder were anchored to the iron powder by a eutectic bonding material of zinc stearate and ethylene bisstearic amide (secondary mixing). Then, 0.3 wt % of ethylene bisstearic amide and 0.1 wt % zincstearate were added, followed by being uniformly mixed and heating, and followed by discharging from the heat mixing unit (third mixing). The foregoing method is hereinafter called Mixing Method 2.

The following Table 1 illustrates results obtained.

TABLE 1

| | Particle size of agglomeration of Copper Powder μm | Primary particle size μm | Degree of adhesion of graphite % | Degree of adhesion of copper | Fluidity sec/50 g | Mixing method | |
|---|---|---|---|---|---|---|---|
| Example 1 | 21 | 0.97 | 80 | 1.9 | 24.2 | 2 | Electrolytic copper powder |
| Example 2 | 12.3 | 1.3 | 82 | 1.8 | 23.5 | 1 | Electrolytic copper powder |
| Example 3 | 23.8 | 0.68 | 85 | 1.4 | 23.8 | 2 | Reduction powder of copper oxide |
| Example 4 | 15 | 0.65 | 83 | 1.3 | 24.1 | 1 | Reduction powder of copper oxide |
| Example 5 | 26.8 | 0.74 | 82 | 1.9 | 24.2 | 1 | Reduction powder of copper oxide |
| Example 6 | 5.02 | 0.36 | 81 | 1.1 | 23.5 | 1 | Copper oxide powder |
| Comparative Ex. 1 | 30.4 | 1.72 | 81 | 2.38 | 24.2 | 1 | Electrolytic copper powder |
| Comparative Ex. 2 | 28.3 | 0.75 | 80 | 2.35 | 24.1 | 1 | Electrolytic copper powder |
| Comparative Ex. 3 | 21 | 1.8 | 82 | 2.33 | 23.9 | 2 | Electrolytic copper powder |

Examples 1 to 6 and Comparative Examples 1 to 3

In Examples 1 and 2, air-classified electrolytic copper powder was used. In Examples 3 and 4, copper powder manufactured by reducing copper oxide was used. In example 6, copper oxide powder was used. The degree of adhesion of graphite, the degree of adhesion of copper and fluidity of each mixture were evaluated. The results of evaluation were collectively shown in Table 1 together with the mixing methods. The degree of adhesion of graphite, that of copper and the fluidity were defined as follows.

Degree of Adhesion of Graphite=(Content of C in −100 Mesh to+200 Mesh Mixed Powder)/(Quantity of C in Overall Mixed Powder)×100 (%)

Degree of Adhesion of Copper=(Quantity of Cu in−325-Mesh Mixed Powder)/(Quantity of Cu in Overall Mixed Powder)×100 (%)

Fluidity: conformed to JIS Z2502

Note that the particle size of agglomeration and the primary particle size of copper powder were measured by the foregoing methods.

In Examples 1 to 6, when the copper powder had its particle size of agglomeration evaluated by the micro-track method and it was about 5 μm to 28 μm and the primary particle size evaluated by the BET method was about 0.2 μm to 1.5 μm, an excellent degree of adhesion of 1 to 2 was realized for either Mixing Method 1 or Mixing Method 2.

In comparison between Examples 1 and 2 and Examples 3 and 4, a larger quantity of copper was adhered in Examples 3 and 4 (when the degree of adhesion of copper was low, excellent adhesion results were realized). The foregoing phenomenon relates to the fact that reduction powder of copper oxide has a shape that includes small voids. In Comparative Example 1, electrolytic copper powder for use usually in iron-base powder metallurgy was used which had a large particle size of agglomeration and primary particle size, resulting in unsatisfactory adhesion of copper. In Comparative Examples 2 and 3, copper powder having a large particle size of agglomeration and primary particle size, resulted in unsatisfactory adhesion of copper. All of the examples resulted in an excellent degree of adhesion of graphite and satisfactory fluidity for this invention.

Examples 7 to 13 and Comparative Examples 4 to 6

Copper powder employed in Examples 2 and 4 and Comparative Example 1 was used and powder mixtures were manufactured by Mixing Methods 1 and 2. A 10% ethanol solution of PVB in a predetermined quantity was mixed with the copper powder, followed by drying, crushing and dissecting so that PVB was caused to adhere in a quantity of about 0.08 wt % to 0.5 wt %. Results of Examples 7 to 13 and Comparative Examples 4 to 6 are collectively shown in Table 2. The degree of adhesion of graphite powder, the degree of adhesion of copper and the fluidity were similar to those shown in Table 1. Powder having its particle size of agglomeration evaluated by the micro-track method of about 5 μm to 28 μm and a primary particle size evaluated by the BET method of about 0.2 μm to 1.5 μm and PVB adhered to the surface in a quantity of about 0.1% to 2% resulted in copper powder being caused to adhere in a larger quantity as compared with Examples 2 and 4 (the degree of adhesion of copper was low). If the degree of adhesion of PVB is lower than about 0.1% (Example 13), the improvement could not be obtained. In Comparative Examples 4 to 6, since the particle size of agglomeration and the primary particle size of copper powder were large, copper could not be satisfactorily adhered even after PVB was allowed to adhere. It should be noted that PVB could not be allowed to adhere in a quantity larger than about 2%.

TABLE 2

| | Copper powder | Quantity of PVB allowed to adhere (with respect to copper powder) % | Degree of adhesion of graphite % | Degree of adhesion of copper | Fluidity sec/50 g | Mixing method |
|---|---|---|---|---|---|---|
| Example 7 | Copper powder of Example 2 | 0.15 | 84 | 1.4 | 24.2 | 1 |
| Example 8 | Copper powder of Example 2 | 0.2 | 82 | 1.4 | 24.1 | 2 |
| Example 9 | Copper powder of Example 2 | 0.5 | 81 | 1.3 | 23.9 | 1 |
| Example 10 | Copper powder of Example 4 | 0.15 | 82 | 1.1 | 24.0 | 1 |
| Example 11 | Copper powder of Example 4 | 0.2 | 82 | 1.1 | 24.0 | 1 |
| Example 12 | Cppper powder of Example 4 | 0.5 | 83 | 1.0 | 23.8 | 1 |
| Example 13 | Copper powder of Example 2 | 0.08 | 81 | 1.8 | 24.1 | 1 |
| Comparative Ex. 4 | Copper powder of comparative Ex. 1 | 0.15 | 80 | 2.8 | 24.1 | 1 |
| Comparative Ex. 5 | Copper powder of comparetive Ex. 1 | 0.2 | 82 | 2.9 | 23.9 | 1 |
| Comparative Ex. 6 | Copper powder of comparative Ex. 1 | 0.5 | 80 | 2.9 | 24.0 | 1 |

Examples 14 to 19 and Comparative Examples 7 and 8

Powder mixtures were manufactured by the same methods as those employed in Example 1 (Mixing Methods 1 and 2). However, copper powder was employed to which a coupling agent was adhered in various quantities. The coupling agent was adhered to copper powder such that a 10% ethanol solution of the coupling agent and copper powder were mixed in a predetermined quantity, followed by crushing the mixture and dissecting after drying at 100° C. for one hour. The results of Examples 14 to 19 and Comparative Examples 7 and 8 are collectively shown in Table 3. The degree of adhesion of graphite powder, the degree of adhesion of copper and the fluidity were similar to those shown in Table 1.

Where the employed copper powder had a particle size of agglomeration evaluated by the micro-track method and was about 5 μm to 28 μm, and where its primary particle size was evaluated by the BET method and was about 0.2 μm to 1.5 μm, and where the surface was subjected to surface treatment with about 0.1% to 2% Si- or Al-type coupling agent regardless of whether the mixing method was Mixing Method 1 or 2, the copper powder could be further adhered as compared with Examples 2 and 4.

Comparative Example 7 resulted in no effect of addition of the coupling agent in a content larger than 2%. Therefore, Comparative Example 7 was unsatisfactory in view of cost. Comparative Example 8 resulted in adhered coupling agent being too small to improve adhesive properties.

TABLE 3

| | Copper powder | Quality of coupling agent allowed to adhere (with respect to copper powder) | Degree of adhesion of graphite % | Degree of adhesion of copper | Fluidity sec/50 g | Mixing method | Coupling agent |
|---|---|---|---|---|---|---|---|
| Example 14 | Copper powder of Example 2 | 0.6 | 81 | 1.4 | 24.0 | 1 | γ-methacryloxypropyl-trimethoxysilane |
| Example 15 | Copper powder of Example 2 | 1.2 | 82 | 1.4 | 24.1 | 2 | γ-glycidoxypropyl-trimethoxysilane |
| Example 16 | Copper powder of Example 2 | 0.6 | 83 | 1.3 | 23.8 | 1 | N-β(aminoethyl)-γ-aminopropyl-trimethoxysilane |
| Example 17 | Copper powder of Example 4 | 0.6 | 81 | 1.1 | 24.0 | 1 | γ-aminopropyl-trimethoxysilane |
| Example 18 | Copper powder of Example 4 | 0.8 | 82 | 1.1 | 23.9 | 1 | γ-glycidoxypropyl-trimethoxysilane |
| Example 19 | Copper powder of Example 4 | 0.6 | 84 | 1.2 | 24.2 | 1 | acetaalkoxyaluminum diisopropylate |

TABLE 3-continued

| | Copper powder | Quality of coupling agent allowed to adhere (with respect to copper powder) | Degree of adhesion of graphite % | Degree of adhesion of copper | Fluidity sec/50 g | Mixing method | Coupling agent |
|---|---|---|---|---|---|---|---|
| Comparative Ex. 7 | Copper powder of Example 2 | 2.1 | 82 | 1.4 | 24.1 | 1 | γ-glycidoxypropyl-trimethoxysilane |
| Comparative Ex. 8 | Copper powder of Example 2 | 0.05 | 82 | 1.8 | 24.1 | 1 | γ-glycidoxypropyl-trimethoxysilane |

Example 20 to 22 and Comparative Example 9

As the copper powder, copper powder to which graphite powder was adhered in various quantities was employed. Graphite powder was adhered to copper powder such that graphite powder was dispersed in 10% ethanol solution of PVB so as to be mixed with copper powder, followed by being dried while being mixed. Results of Examples 20 to 22 and Comparative Example 9 were shown in Table 4. In the case where 0.1% to 2% graphite powder was adhered to the surface of copper powder having particle size of agglomeration evaluated by the micro-track method of about 5 μm to 28 μm and its primary particle size evaluated by the BET method was about 0.2 μm to 1.5 μm, the adhesion of copper was improved as compared with Example 2. Comparative Example 9, in which graphite powder was caused to adhere in a small quantity, could not improve the adherability of copper.

TABLE 4

| | Copper powder | Degree of adhesion of graphite (with respect to copper powder) | Degree of adhesion of graphite % | Degree of adhesion of copper | Fluid sec/50 g | Mixing method |
|---|---|---|---|---|---|---|
| Example 20 | Copper powder of Example 2 | 0.1 | 82 | 1.3 | 24.1 | 1 |
| Example 21 | Copper powder of Example 2 | 0.5 | 83 | 1.3 | 23.9 | 2 |
| Example 22 | Copper powder of Example 2 | 1 | 80 | 1.2 | 24.4 | 1 |
| Comparative Ex. 9 | Copper powder of Example 2 | 0.05 | 82 | 1.8 | 24.1 | 2 |

In the foregoing cases, graphite powder could not be adhered in a quantity larger than about 2%.

Since the iron-base powder mixture for powder metallurgy according to the present invention has the foregoing structure, segregation and dust generation of added copper powder can satisfactorily be prevented. Further, undesirable changes of fluidity can be prevented, and variation of the product with time can be prevented. The iron-base powder mixture for powder metallurgy can easily be manufactured by the manufacturing method according to the present invention.

Although the invention has been described with reference to selected preferred forms, and with a certain degree of particularity, it should be understood that the disclosure contemplates the use of alternatives and equivalents, and the use of certain features of the invention independently of other features. Further, disclosure of preferred forms can be changed or amplified in regard to the details of construction and in the combination and arrangement or rearrangement of components and method steps, all without departing from the spirit and the scope of the invention as hereinafter claimed.

What is claimed is:

1. An iron-base powder metallurgy mixture comprising:

iron-base powder;

an alloy powder containing at least copper powder or copper oxide powder; and an organic substance in bonding connection to said alloy powder for bonding said alloy powder to said iron-base powder, wherein said alloy powder comprises an agglomerate of copper powder or copper oxide powder which has a particle size, evaluated by the micro-track method, of about 5 μm to 28 μm, and wherein the particles of said copper powder or copper oxide powder have a primary particle size evaluated by the BET method, of about 0.2 μm to 1.5 μm.

2. An iron-base mixture according to claim 1, wherein a portion of said copper or copper oxide content of said powder metallurgy mixture passes through a 325-mesh screen and is bound as a part of the total content of copper in the overall iron-base mixture, and wherein the adhesion degree of Cu powder to iron powder, which is defined by the following equation:

$$\frac{\text{Cu content of mixed powder passed through a mesh 325\# screen}}{\text{Cu content of overall mixed powder}}$$

is about 2 or less.

3. An iron-base mixture according to claim 2, further comprising 0.wt % to 2 wt % graphite adhered to the surface of said copper or copper oxide powder.

4. An iron-base mixture according to claim 1, wherein said organic substance is a eutectic of fatty acid and metallic soap or a combination of two or more waxes having different melting points.

5. An iron-base mixture according to claim 4, further comprising 0.1 wt % to 2 wt % graphite adhered to the surface of said copper or copper oxide powder.

6. An iron-base mixture according to claim 1, further comprising 0.1 wt % to 2 wt % polyvinylalcohol adhered to the surface of said copper powder.

7. An iron-base mixture according to claim 1, further comprising 0.1 wt % to 2 wt % Si coupling agent or Al coupling agent adhered to the surface of said copper or copper oxide powder.

8. An iron-base mixture according to claim 1, further comprising 0.1 wt % to 2 wt % graphite adhered to the surface of said cooper or copper oxide powder.

9. An iron-base mixture according to claim 1, wherein said copper powder is an oxidation-reduction copper powder.

* * * * *

UNITED STATES PATENT AND TRADEMARK OFFICE

CERTIFICATE OF CORRECTION

PATENT NO. : 5,766,304

DATED : June 16, 1998

INVENTOR(S) : Uenosono, et al

It is certified that error appears in the above-indentified patent and that said Letters Patent is hereby corrected as shown below:

In column 3, line 8, please change "Alloy Powder" to --Copper Powder or Copper Oxide Powder--.

In column 12, claim 2, line 61, please change "mesh 325#" to --325 mesh--; and line 66, please change "0.wt %" to --0.1 wt %--.

Signed and Sealed this

Eighth Day of December, 1998

Bruce Lehman

*Attest:*

BRUCE LEHMAN

*Attesting Officer*

*Commissioner of Patents and Trademarks*